US006733087B2

(12) United States Patent
Hall et al.

(10) Patent No.: US 6,733,087 B2
(45) Date of Patent: May 11, 2004

(54) PICK FOR DISINTEGRATING NATURAL AND MAN-MADE MATERIALS

(76) Inventors: David R. Hall, 2185 S. Larsen Pkwy., Provo, UT (US) 84606; Joe R. Fox, 2185 S. Larsen Pkwy., Provo, UT (US) 84606

( * ) Notice: Subject to any disclaimer, the term of this patent is extended or adjusted under 35 U.S.C. 154(b) by 9 days.

(21) Appl. No.: 10/216,266

(22) Filed: Aug. 10, 2002

(65) Prior Publication Data

US 2004/0026132 A1 Feb. 12, 2004

(51) Int. Cl.[7] ..... E21C 25/04
(52) U.S. Cl. ..... 299/113; 299/111
(58) Field of Search ..... 299/113, 111, 299/110, 105, 104, 79.1; 175/412

(56) References Cited

U.S. PATENT DOCUMENTS 4,941,711 A * 7/1990 Stiffler ..... 299/113
4,945,073 A * 7/1990 Dubensky et al. ..... 501/93
5,074,623 A * 12/1991 Hedlund et al. ..... 299/111
5,112,165 A * 5/1992 Hedlund et al. ..... 407/118
5,141,289 A * 8/1992 Stiffler ..... 299/111
5,950,742 A * 9/1999 Caraway ..... 175/57
6,051,079 A * 4/2000 Andersson et al. ..... 148/318
6,065,552 A * 5/2000 Scott et al. ..... 175/374
6,199,956 B1 * 3/2001 Kammerer ..... 299/111
2002/0034631 A1 * 3/2002 Griffin et al. ..... 428/332

* cited by examiner

*Primary Examiner*—David Bagnell
*Assistant Examiner*—Daniel P Stephenson

(57) ABSTRACT

An attack tool for working natural and man-made materials that is made up of one or more segments, including a steel alloy base segment, an intermediate carbide wear protector segment, and a penetrator segment comprising a carbide substrate that is coated with a superhard material. The segments are joined at continuously curved interfacial surfaces that may be interrupted by grooves, ridges, protrusions, and posts. At least a portion of the curved surfaces vary from one another at about their apex in order to accommodate ease of manufacturing and to concentrate the bonding material in the region of greatest variance. The carbide used for the penetrator and the wear protector may have a cobalt binder, or it may be binderless. It may also be produced by the rapid omnidirectional compaction method as a means of controlling grain growth of the fine cobalt particles. The parts are brazed together in such a manner that the grain size of the carbide is not substantially altered. The superhard coating may consist of diamond, polycrystalline diamond, cubic boron nitride, binderless carbide, or combinations thereof.

12 Claims, 9 Drawing Sheets

PICK FOR DISINTEGRATING NATURAL AND MAN-MADE MATERIALS

TITLE OF THE INVENTION

A pick for disintegrating natural and man-made materials

RELATED APPLICATIONS

None

BACKGROUND OF THE INVENTION

This invention relates to a tool for disintegrating natural and man-made materials such as coal, asphalt, and other useful mineral deposits. It may also be useful in subterranean excavations associated with tunneling and with the placement of subsurface cables, conduits, and pipes. The principles disclosed herein may also have application in the drilling and maintenance of oil, gas, and geothermal wells.

With respect to mining, tools of the class disclosed herein are typically rotationally mounted to a mining excavation machine or a road milling machine. It is desirable that the tool rotates in its attachment so as to avoid non-uniform wear that is likely to reduce the life of the tool in the field.

Generally, the tool is mounted cooperatively with other similar tools on a drum or wheel that also rotates, driving the tools in succession against the natural or man-made formation being worked. Because each tool encounters the formation at an angle, side loading, bending, and rapid accelerations are the stresses experienced by the tools. Furthermore, the materials being worked are often abrasive in nature, or in the case of coal and other less abrasive minerals, are found in abrasive formations that of necessity must be removed in order to extract the target material. High stresses, heat, and abrasion all combine to contribute to the rapid failure of attack tools during use. It is not uncommon for such tools to only last a few hours in actual use, even when the tools are provided with tough carbide inserts and wear surfaces. The dollar cost of individual tools and the down time associated with the replacement of worn out tools are a major expense. It is, therefore, desirable to provide an attack tool having greater durability.

The art is replete with attempts to describe tools that may last longer in use. The investigator is referred to a line of patents culminating in U.S. Pat. No. 6,051,079, incorporated herein by this reference, for a discussion of the prior art and exemplary attempts to overcome the well-documented problems associated with producing a satisfactory tool. Those well versed in the art will acknowledge that the heretofore proposed improvements have not produced a tool that has gained commercial acceptance in the industry, notwithstanding the fact that the proposals have merit in some cases. Therefore, the objective of this disclosure is to advance a tool that overcomes the deficiencies of the prior art and that is suitable for widespread acceptance in the industry.

SUMMARY OF THE INVENTION

This invention discloses an attack tool like that for use in the mining and asphalt excavation. The tool features a segmented assembly consisting of a base that is adapted for rotational attachment to mining and excavation equipment, an intermediate wear protector composed of a carbide material that is configured to protect the base from wear during use and to assist in the disintegration of the natural or man-made materials being worked; and a penetrator tip segment, also configured to promote disintegration of the materials being worked. The penetrator consists of a carbide substrate that has a coating of superhard material, such as polycrystalline diamond, cubic boron nitride, or binderless carbide on its working surface. An innovative feature of this invention is that the three segments are bonded along an unmatched, continuously curved interface that enhances attachment and reduces the likelihood of failure due to acceleration and stresses associated with the use of the tool in the field. The interfacial surfaces of the curved interface are not entirely matching in order to accommodate ease of manufacturing and to provide a region where the bonding material may be concentrated. The region of greatest variance is provided at or near the apex, or projected apex, of the curved surfaces, i.e. the region of highest curvature. The apex region is thought to be the least susceptible to bending stresses and accelerations that are likely to promote failure of the bond during use. Additional innovative features will be discussed further in the following detailed discussion of the invention.

DETAILED DESCRIPTION OF THE INVENTION

Figure 1:
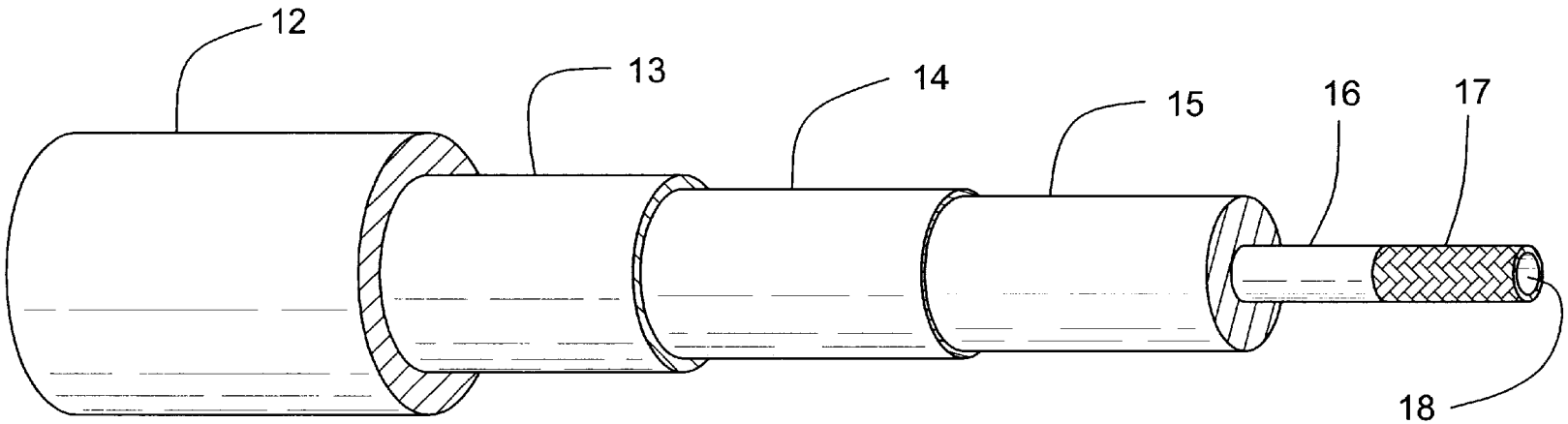
FIG. 1 is a representation of a pick type tool of the present invention.

Disclosed herein is an excavating tool, also know as a "pick" or an "attack tool" for use in disintegrating natural and man-made formations such as coal and asphalt. The tool consists of bonded segments in the form of a tool body, or base, an intermediate wear protector, and a generally conical penetrator. The wear protector and the penetrator are at least partially composed of a carbide material that is streamlined to promote the efficient flow of material away from the attack tool. The primary function of the wear protector is to shield the tool body from the abrasive particles encountered in order to reach, disintegrate, and remove the target material and surrounding formations. The penetrator is coated with a superhard material having high abrasion resistance such as polycrystalline diamond or cubic boron nitride. These superhard materials are used to prolong the life the carbide components. As will be shown in the figures, the attack tool of the present invention exhibits a continuous curve, or projected curve, at the interface between the segments. The curved configuration is thought to distribute stress, and dampen accelerations, normally associated with the use of the tool. It is believed that the interfacial surfaces should not be entirely matched in order to provide a region for concentrating the braze material used to bond the components of the tool together. The unmatched portion of the curved interfaces is located at about the apex, or projected apex, of the curve where stresses and accelerations are less likely to have an impact on the life and performance of the tool. The location of the braze concentration is, therefore, thought to be beneficial in maintaining the bond between the components. Failure of the bond and wear of the components are the leading causes of premature failure of the pick tools.

Normally, an attack tool encounters the formation at an angle under the driving force of a road or a long-wall milling machine. Under these conditions the tool experiences considerable side loading and so a tool body having high strength is required. Typically, tool bodies, or the base of the tool, are composed of high-strength alloy steel. The other components of the tool must also have sufficient strength to withstand the stresses of use. In addition to high contact stresses, heat is also generated by the frictional engagement of the tool against the formation. Therefore, the materials used in the tool must be unaffected by the high temperature conditions associated with material disintegration in order to achieve extended tool life.

Carbide materials are preferred for use in attack tools because they have an attractive combination of good thermal properties, high hardness, toughness, and wear resistance. The tool of the present invention incorporates carbide at locations most likely to experience the highest stresses and abrasion. By altering the composition of the carbide and its method of production, improvements in its performance may be achieved, or at least tailored to a particular application. For example, carbide can be made to have even higher abrasion resistance by the addition of diamond particles in the carbide matrix. Also, metal bonded carbide that is clad with a layer of binderless carbide is more thermally stable and resistant to leaching of the metal bond, and, therefore, more resistant to wear in high abrasive environments and under conditions that include the use of fluid coolants. Another form of carbide that is useful in high stress/high wear applications is metal bonded carbide that produced by the ROC, or rapid omni-directional compaction, process. An example of this process is disclosed in U.S. Pat. Nos. 4,744,943 and 4,945,073. Dow Chemical Company, Midland, Mich., is the assignee of these patents and is an available source of such carbide produced by the ROC method. One of the advantages of the ROC carbide is that the grain growth of the metal binder is controlled during the sintering process. This enables an end product that maintains its toughness and has a finer grain size that equates to higher hardness numbers, and, therefore higher abrasion resistance. Binderless carbide by the ROC method has especially high hardness measuring above 95.0 HRA (Rockwell "A"). Although, this form of carbide is too brittle to withstand the bending stresses experienced by the attack tool, the benefits of this form of carbide may be imparted to the tool by cladding the tool body, the wear protector, and the penetrator substrate with binderless carbide.

Improved performance of the penetrator segment may also be achieved by varying the composition of the superhard ploycrystalline diamond (PCD) coating. Superhard coatings may be commercially applied to the carbide substrate that forms the intermediate and penetrator segments by the highpressure high-temperature (HPHT) method or by the CVD method. The HPHT method is preferred because it produces a more competent bond between the superhard layer and the carbide substrate as well as more thorough particle to particle chemical bonding resulting in an integral coating that has high wear resistance and high impact strength. PCD having a low percentage of cobalt, or other sintering aid, or PCD that is produced without the aid of a metal catalyst binder is more thermally stable and, therefore, more wear resistant. High thermal stability may also be achieved by removing the residual metal catalyst from the at least the working surface of the segment. Removal of the catalyst may be accomplished either by chemical leaching, polishing, or by providing an additional material in the diamond matrix that transforms the residual metal catalyst into a non-catalytic material. See U.S. patent application Ser. No. 2002/0034632, Published Mar. 21, 2002, to Griffin, et al., incorporated herein by this reference.

The following figures are exemplary representations of the pick tool of the present invention. They are offered by way of illustration only and teachings of this disclosure are not limited thereby. Those skilled in the art will recognize additional applications of the teachings herein, and that recognition is also a part of this disclosure.

FIG. 1 is a representation of a pick type tool of the present invention. It features a generally cylindrical body (15), or base segment, of a high strength steel alloy that at one end has a means (16) for rotational attachment to a driving mechanism. The mechanism may be a long-wall mining machine for coal, or a road-milling machine, in the case of asphalt removal. The tool is usually mounted on a rotating drum that is driven into the target formation and moved laterally across the formation in order to uniformly remove the target material. The intermediate segment (17) is composed of a material that has higher wear resistance than the base (15) and serves to shield the base from wear during use. Intermediate segment (17) is contoured to promote the efficient flow of disintegrated material away from the pick tool. A penetrator segment (18) is located adjacent the intermediate segment (17) opposite the base (15). The penetrator segment is at least as abrasion resistant as the intermediate portion and serves to penetrate and disintegrate the target material.

Figure 2:
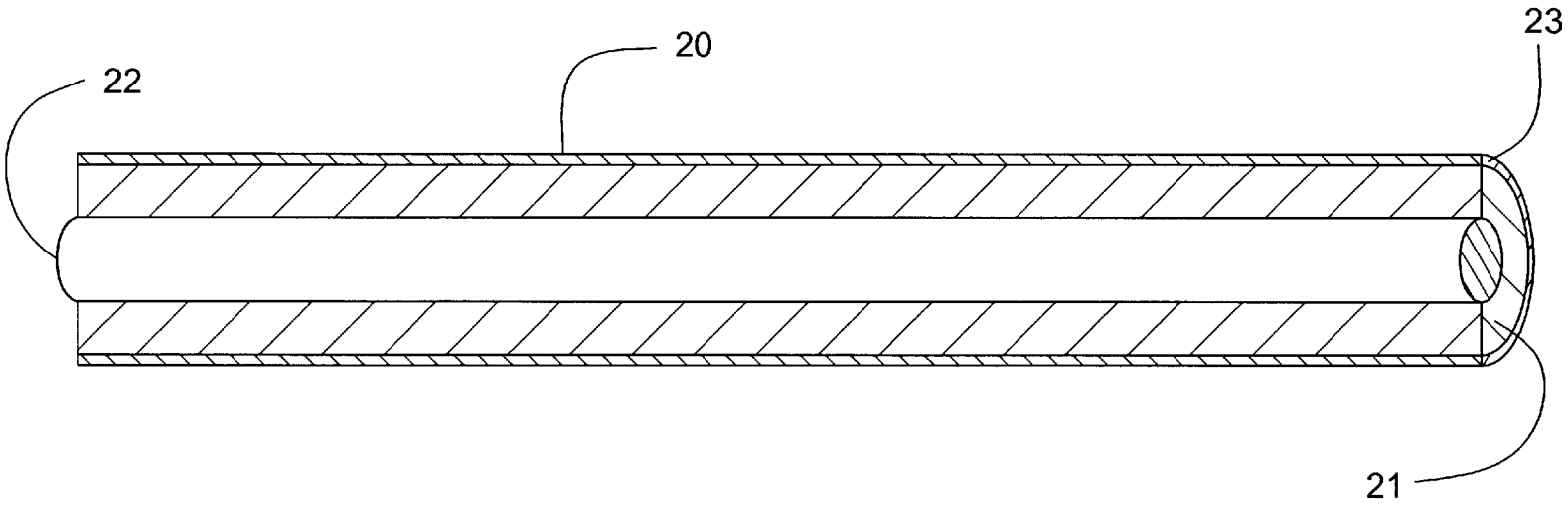
FIG. 2 is a representation of the tool of FIG. 1 having its upper portion cut away to expose unmatched interfaces.

FIG. 2 is a cut away view of the pick tool demonstrated in FIG. 1. Its base 20 is designed for rotational attachment to the driving mechanism )not shown), while its overall shape provides for efficient flow of the target material around the tool during use. The cut away portion (21) exposes the interfacial surfaces of the related segments. The interfacial surface (22) where the base (20) joins the intermediate segment (23) demonstrates a continuously curved unmatched interfacial surface. The region of highest divergence of the unmatched surfaces is near the region of highest curvature, or apex of the interfacial surface. The unmatched, continuously curved interfacial surfaces serve to reduce stresses associated with pick use. They also provide a space for concentrating the bonding material at a location where it is least likely to experience high bending stresses that are likely to cause the bond between the base and intermediate segments to fail during use. In a similar fashion, the continuously curved, unmatched interfacial surface (24) joining the intermediate segment to the penetrator tip (25) also provides a means for reducing stresses and protects the bonding material from failure during use.

Figure 3:
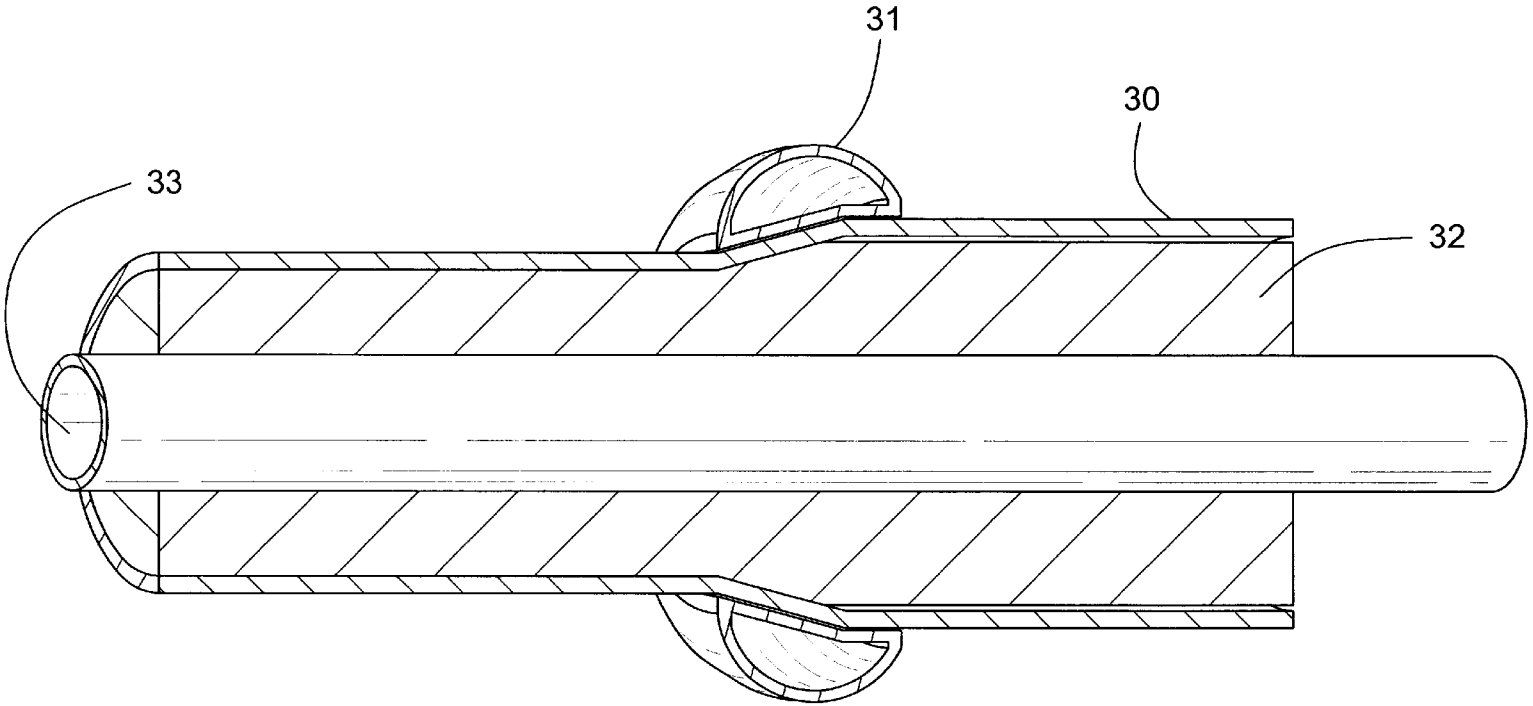
FIG. 3 is a representation of a penetrator segment of the present invention.

FIG. 3 is a representation of a penetrator segment of the present invention. The penetrator segment shown in FIG. 3 consists of a unitary, cemented carbide substrate (30) having a conical working surface (31) and a shank (32) that features optional flutes (33) and a continuously curved interfacial surface for bonding (34). The interfacial surface is unmatched to the mating surface in the intermediate segment in order to provide a region for concentrating the bonding material where it is least likely to experience high stresses that may lead to failure of the bond. The penetrator segment may be attached to the base segment or it may be bonded to an intermediate segment that is positioned between the base and penetrator segments.

Although cemented carbide is the preferred material for the penetrator in this application for its high abrasion resistance, its toughness is less than that of the alloy steel of the base, making is more notch sensitive. In order to take advantage of this type of material, the corners and edges of the penetrator are rounded as a means of reducing its notch sensitivity. The applicants have also found that when the surface asperities are reduced, for example by polishing the surfaces of the penetrator, the transverse fracture resistance of the penetrator is increased, making it more resistant to crack propagation when experiencing the bending and accelerations during field use. As mentioned above, additional improvement in the performance of the penetrator's wear resistance may be achieved by varying the composition of the substrate material and by using multiple grades of substrate material.

Figure 4:
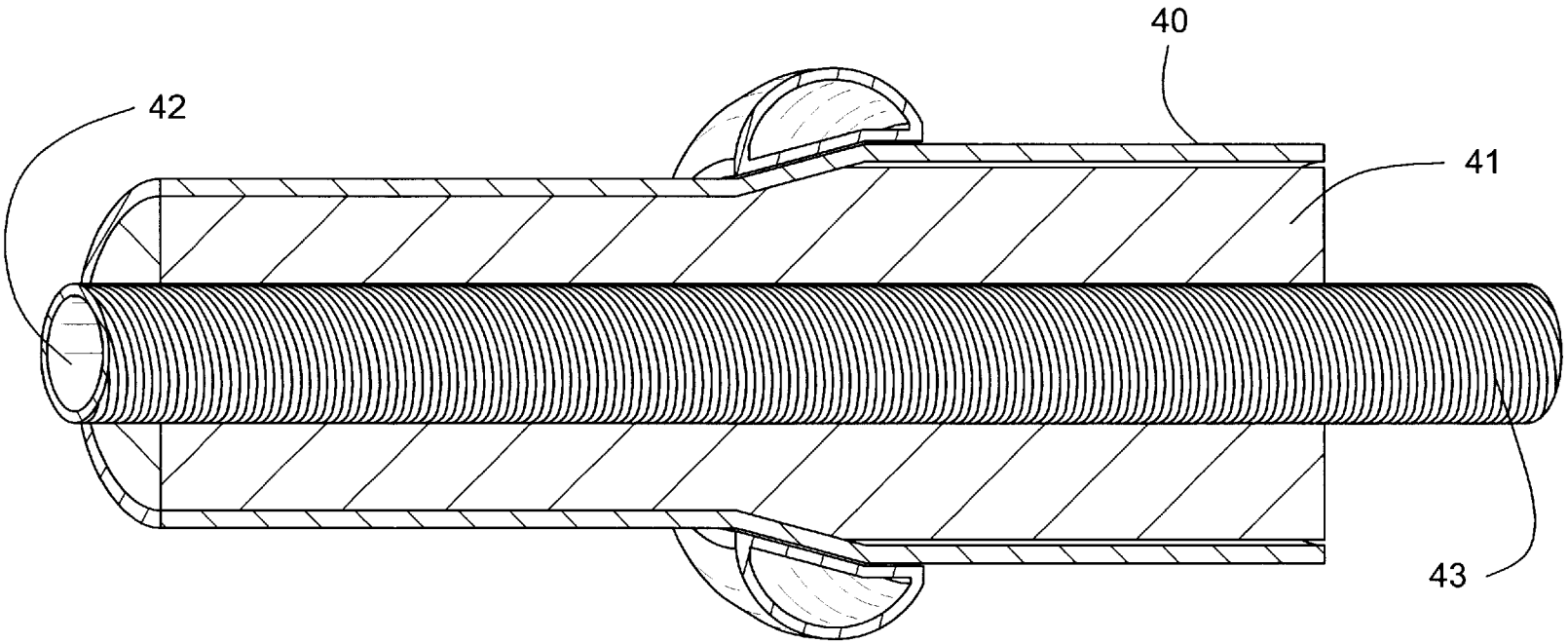
FIG. 4 is a representation of a penetrator segment with cut away of its superhard surface.

FIG. 4 is a further embodiment of the penetrator segment of the present invention. It features a unitary substrate body (40), composed of a cemented carbide, preferably tungsten carbide. Its conical working surface (41) is coated with a material having even greater hardness and abrasion resistance than the substrate material. Such materials include polycrystalline diamond, cubic boron nitride, and a binderless carbide material. As discussed above when these materials are bonded to the substrate, they present a penetrator that exhibits the toughness of the substrate and abrasion resistance of the superhard material. The shank of the penetrator has been formed having a spiral protrusion (42) that function as a thread for mechanical attachment of the penetrator to the base or intermediate segments. Although the unmatched, continuously curved interface at the distal end of the shank is not shown, it would be similar to that shown at (22) of FIG. 2 and (34) of FIG. 3. The conical interfacial surface of the substrate of FIG. 4 has non-planar protrusions 44 that are thought to decrease stress and increase the bond strength between the coating and the substrate. Other variations of this non-planar surface are possible when using dimples, grooves, and flutes. The non-planar features of the interfacial surface may also act as a stress reducing transition region for matching the thermal expansion of the differing materials when blending the hardness of the coating with the toughness of the substrate.

Figure 5:
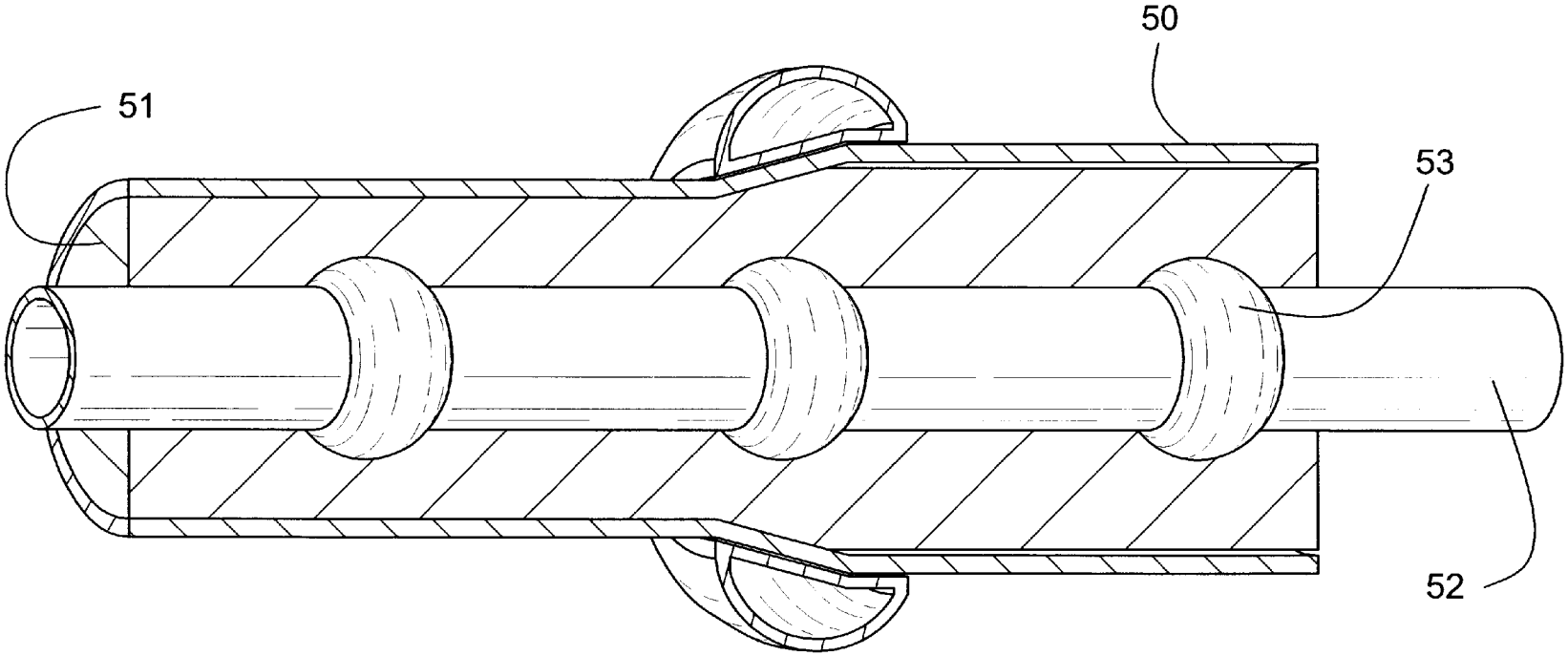
FIG. 5 is a representation of the penetrator segment of FIG. 3 having a slot intersecting one or more of its flutes.

FIG. 5 is another embodiment of the penetrator of FIG. 3. The unitary substrate (50) has a shank (51) with flutes that have been provided with one or more rounded cuts (52) that may be useful when assembling the penetrator to the either the base or intermediate segments. The rounded cut (52) is matched with a corresponding rounded protrusion in the mating segment and serves to retain segment during bonding.

Figure 6:
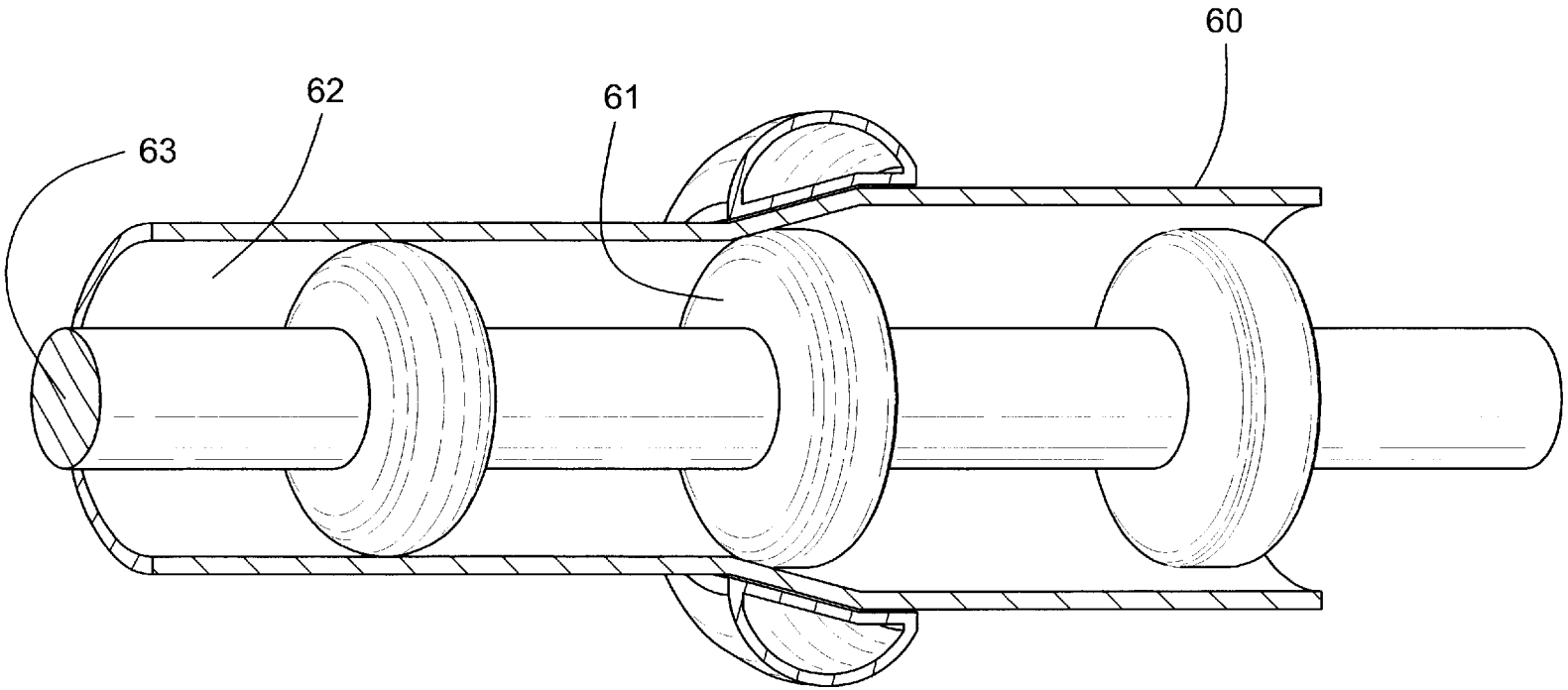
FIG. 6 is a representation of an intermediate wear protector segment of the present invention.

FIG. 6 is a cut away representation of an intermediate segment of the present invention. The intermediate segment is normally disposed between the base and the penetrator. It's primary function is to protect the base from wear and to provide a contoured surface (60) as a means for promoting the efficient flow of material away from the pick during excavation. It has a recess (61) for accepting the penetrator. The recess features rounded corners (62) for stress and notch sensitivity reduction, and may also have threads (63) to aid in attaching the penetrator to the segment. At the distal end of the recess is a continuously curved interfacial surface (64) for bonding the penetrator segment to the intermediate segment. The curve of the interfacial surface (64) diverges from the curve of the mating surface of the penetrator, in the region of its highest curvature. The unmatched interfacial surfaces provide a space for concentrating the bonding material. The applicants believe that the curved interfacial surfaces reduce stress and position the bonding material where it is less likely to fail from the bending and acceleration experienced during disintegration of the target material. A rim (65) is provided in the outside contour of the segment that extends beyond the mating diameter of the base segment. The rim (65) serves to channel away debris from the base segment and, thereby, reduce the wear to the base. The shank of the intermediate element is also provided with a recess for attachment to the base of the tool. The recess may have a smooth interfacial surface or it may feature threads (66). The shank features a continuously curved interfacial surface (67) for attachment to the base segment. The curve of surface (67) diverges from the curve of the apposed surface of the base segment. Although not shown in the prior drawings, the use of recesses for attaching the intermediate segment to the adjoining segments is also applicable for joining the penetrator segment directly to the base segment. The applicants have recognized the benefits of rounded corners and edges when using highly abrasion resistant materials in pick type tool applications as a method of reducing stress and notch sensitivity.

Figure 7:
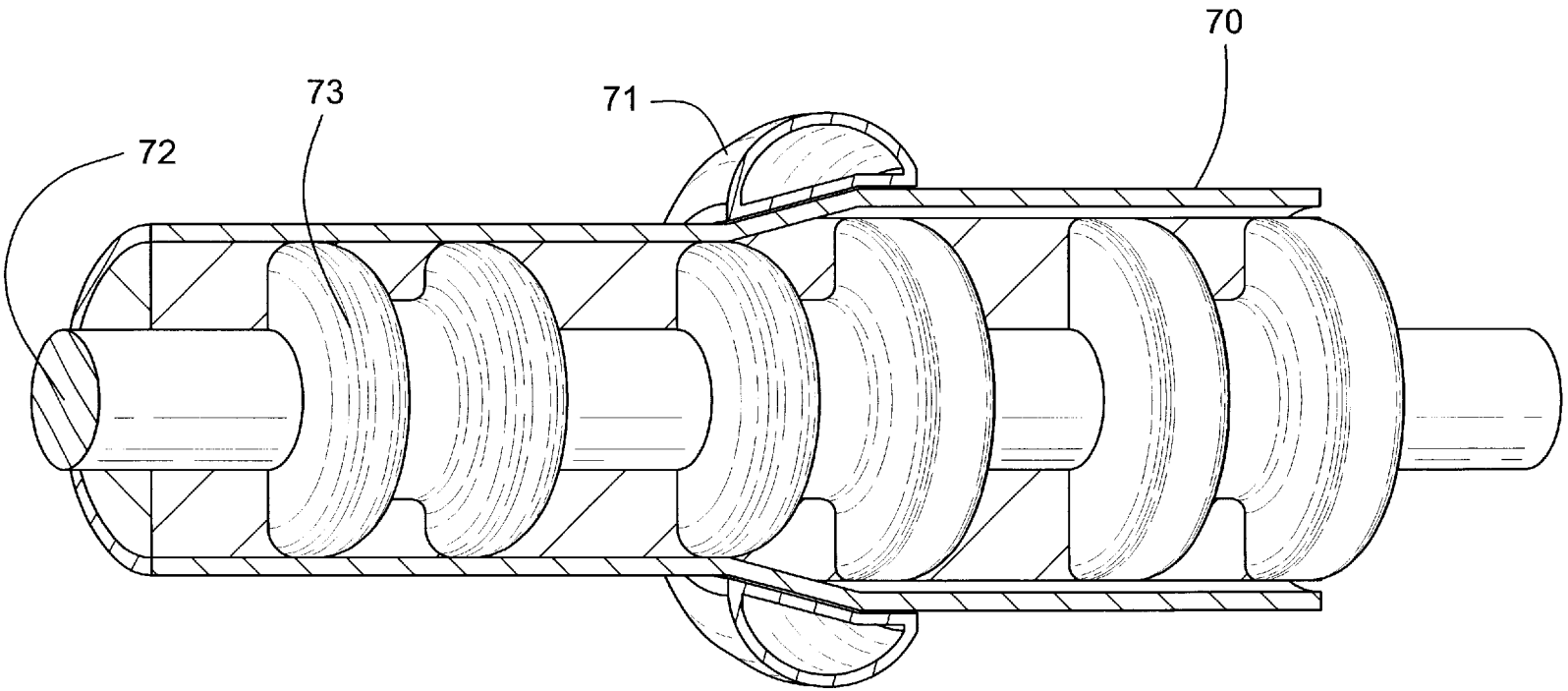
FIG. 7 is a representation of an intermediate wear protector segment of the present invention exhibiting concave curved interfacial surfaces.

FIG. 7 is yet another embodiment of an intermediate segment of the present invention. In addition to its rounded corners and edges, it displays smooth surfaces that discourage crack initiation when the segment experiences the strain of use. The segment displays a projection (70) that increases the cross-sectional area of the segment and promotes the flow of debris away from the tool. An extended continuously curved interfacial surface (71) increases the bond strength between the adjoining segments. The unmatched portion of the interfacial surface (72) promotes concentration of the bonding material in the axial region of least stress, and the recess (73), with its curved interfacial surface, facilitates attachment to the base segment.

Figure 8:
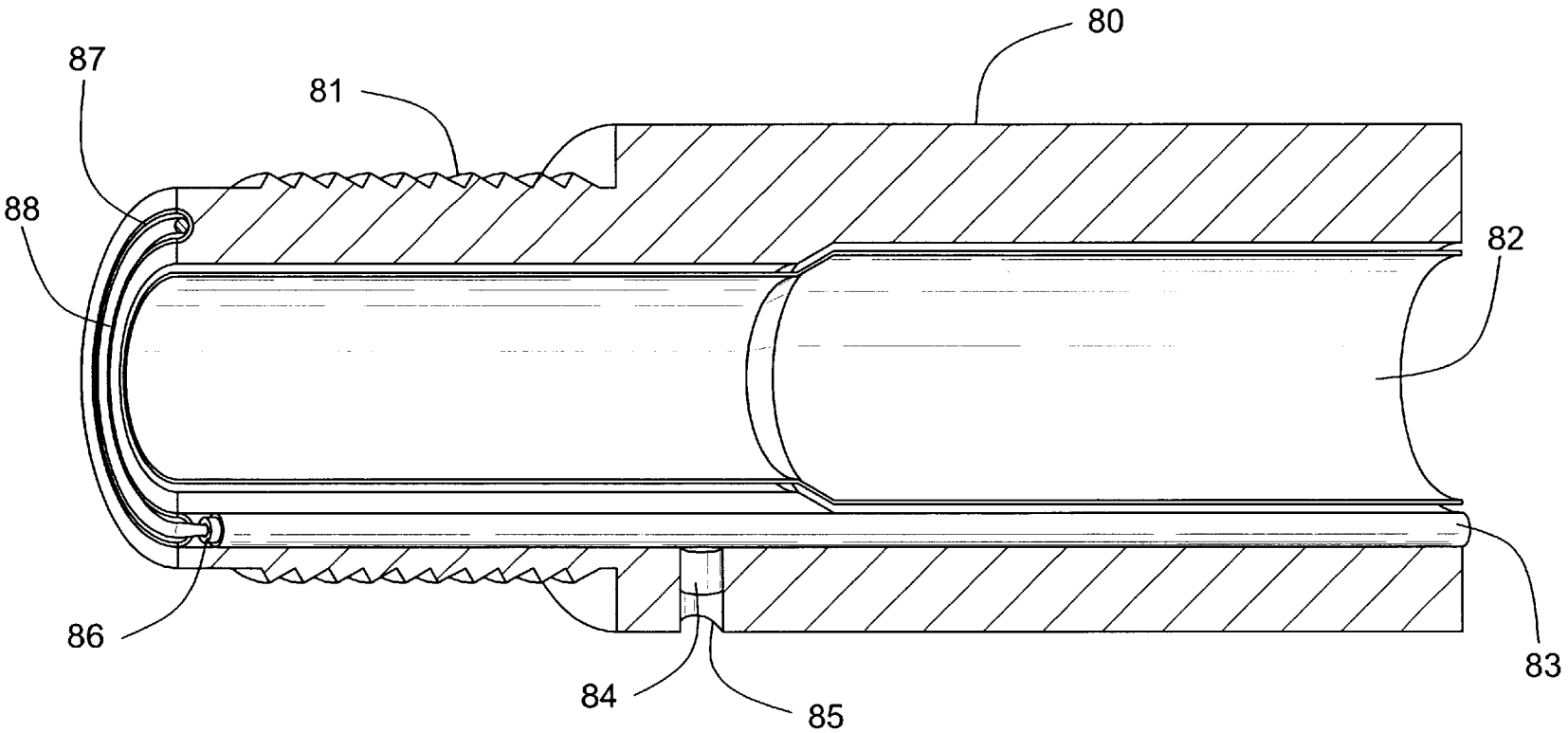
FIG. 8 is a representation of a unitary segment of the present invention.

FIG. 8 is a representation of a penetrator segment of the present invention that combines some of the features of the intermediate segment into a single structure. The segment consists of a substrate (80) having a conical tip (81) that is coated with a superhard material or a composite of cemented carbide and a superhard material. It may also be coated with binderless cemented carbide that would be more abrasion resistant than the carbide substrate. In some applications, it may be desirable not to coat the conical tip at all. The substrate has a projecting contour (82) for flow control of the debris that is disintegrated during excavation, and a continuously curved interfacial surface (83) for attachment to the base. The outside surface of penetrator may be polished to discourage crack initiation that could lead to early failure of the segment.

Figure 9:
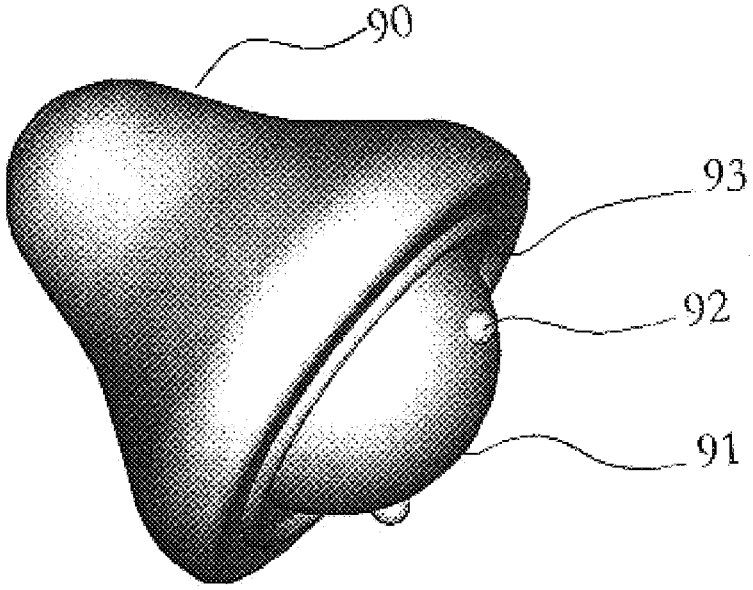
FIG. 9 is a representation of a unitary segment of the present invention having protrusions along its interfacial surface.
Figure 1:
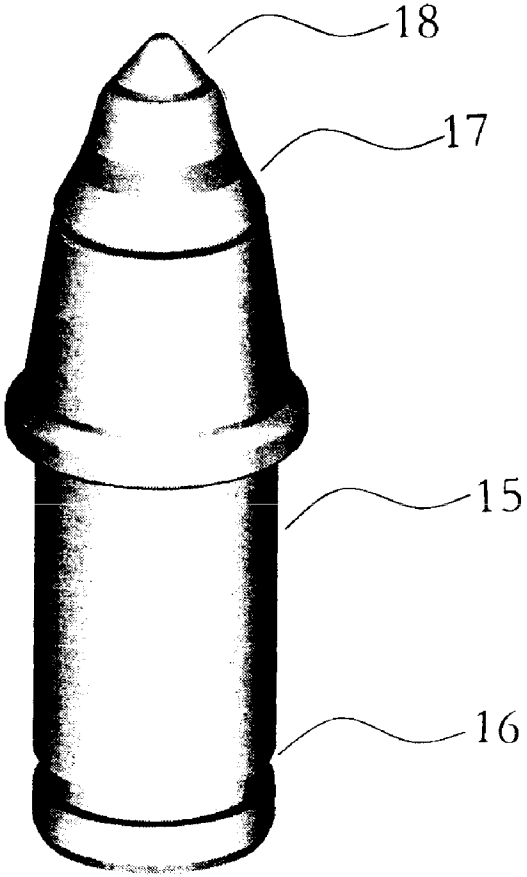
Figure 2:
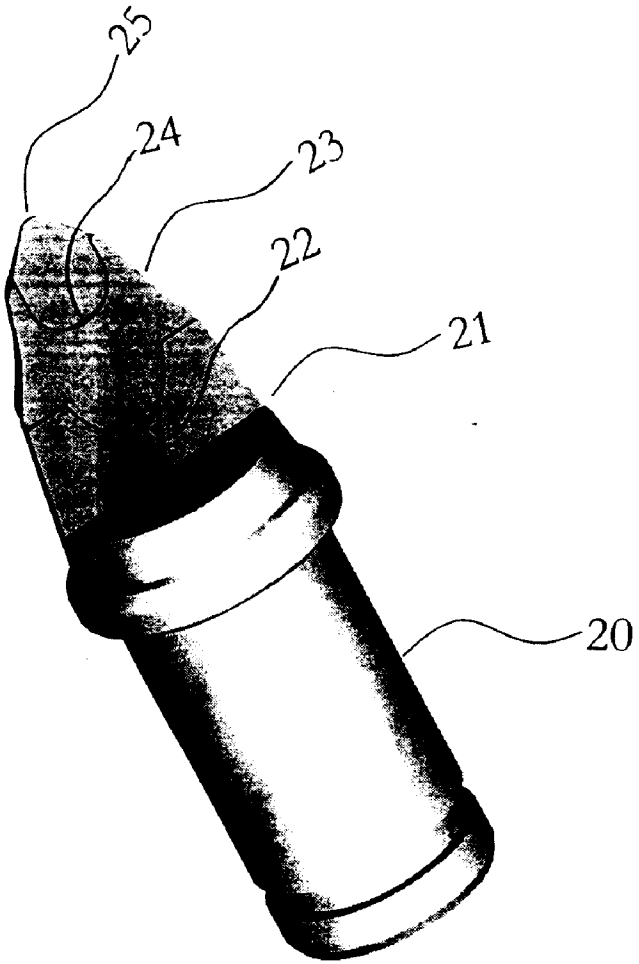
Figure 3:
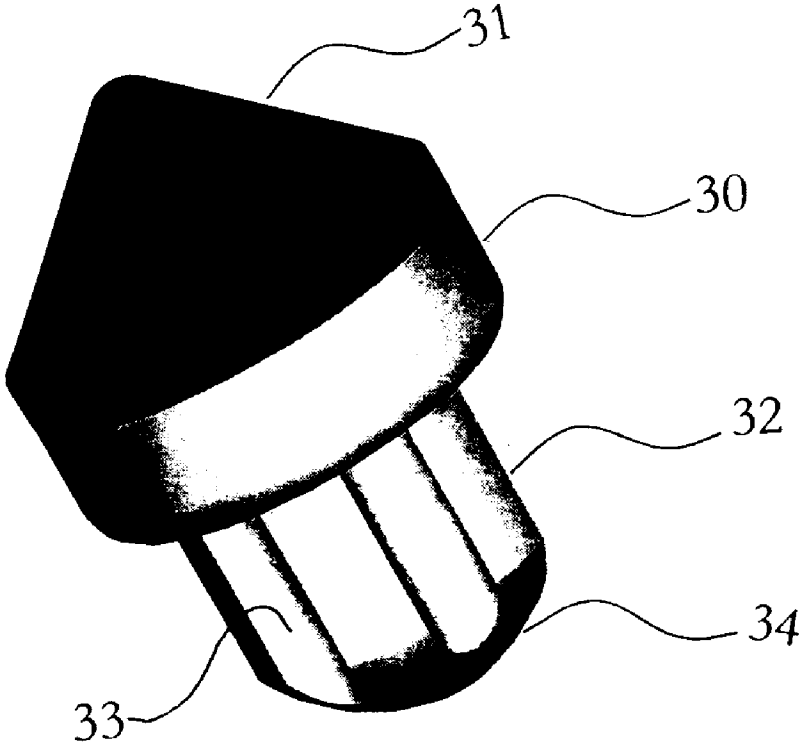
Figure 4:
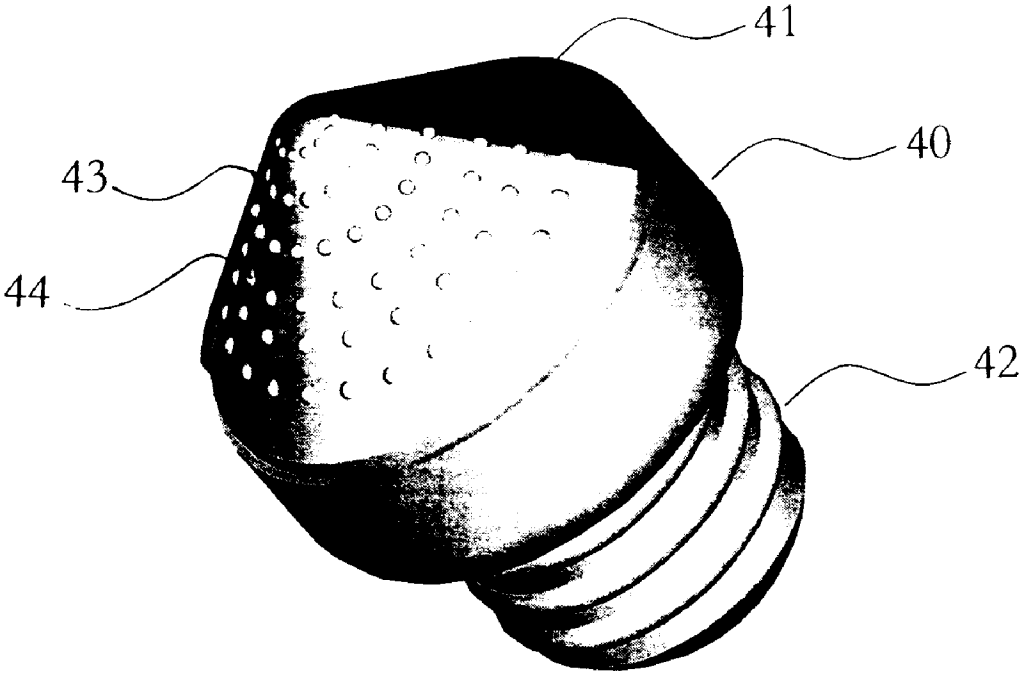
Figure 5:
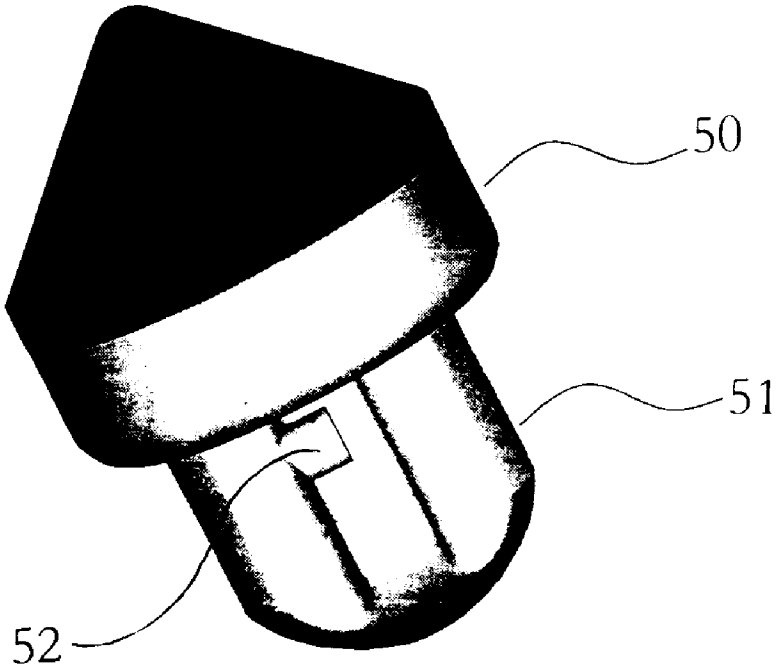
Figure 6:
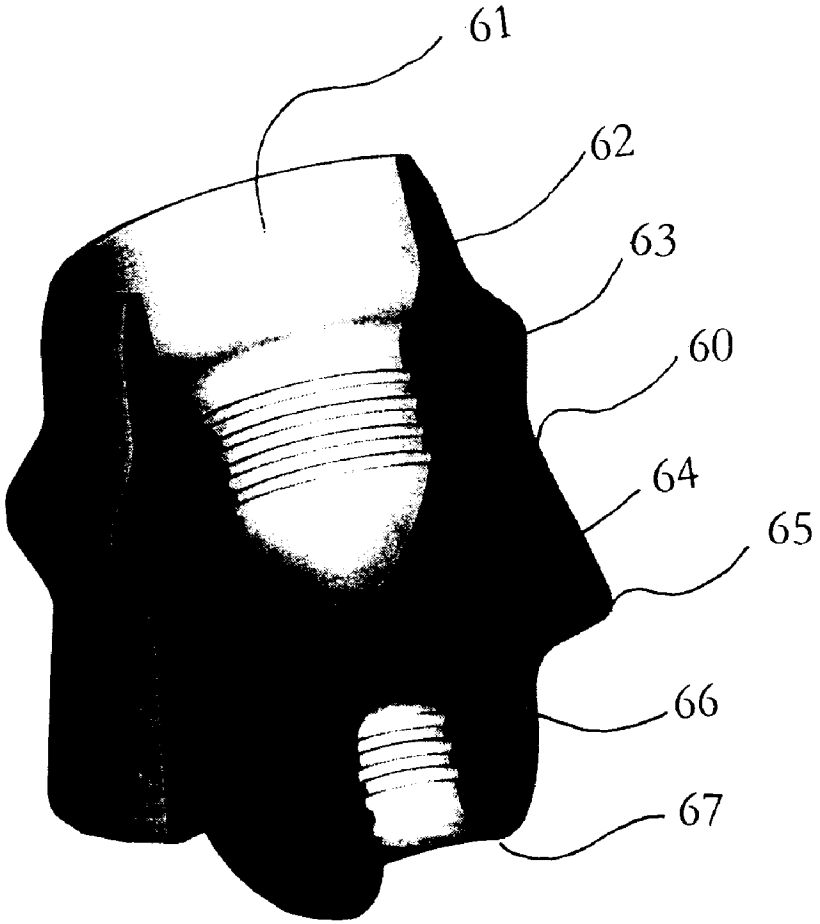
Figure 7:
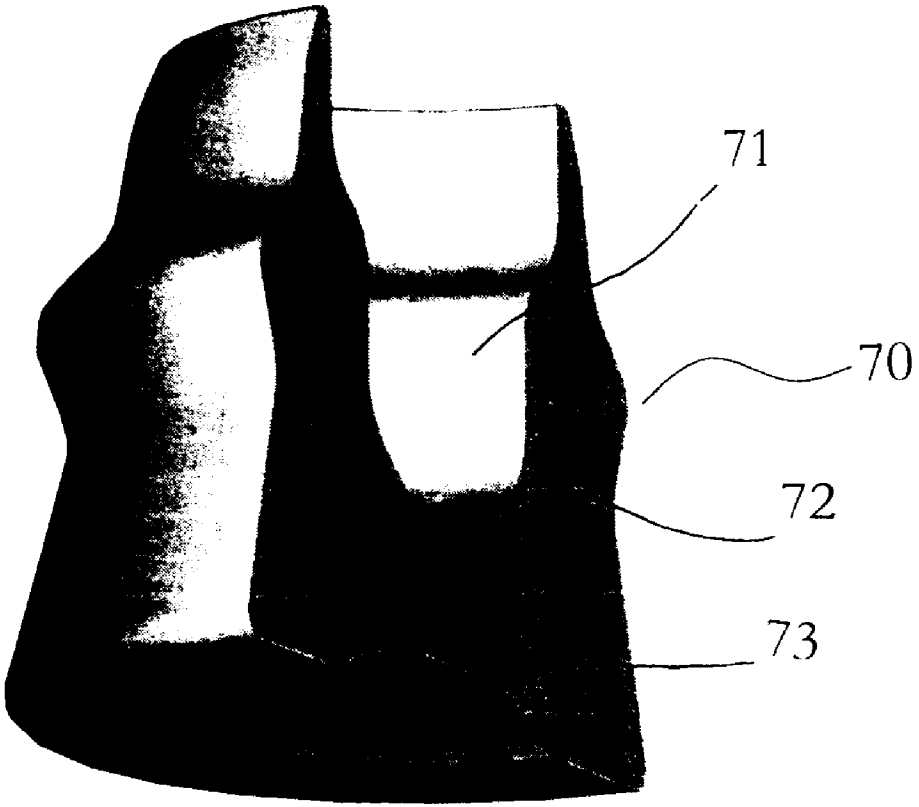
Figure 8:
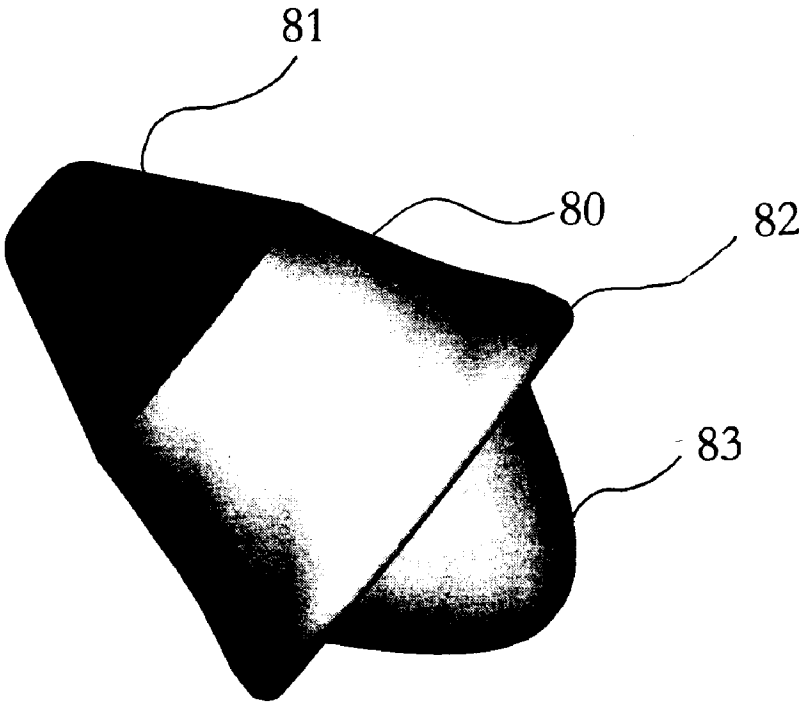
Figure 9:
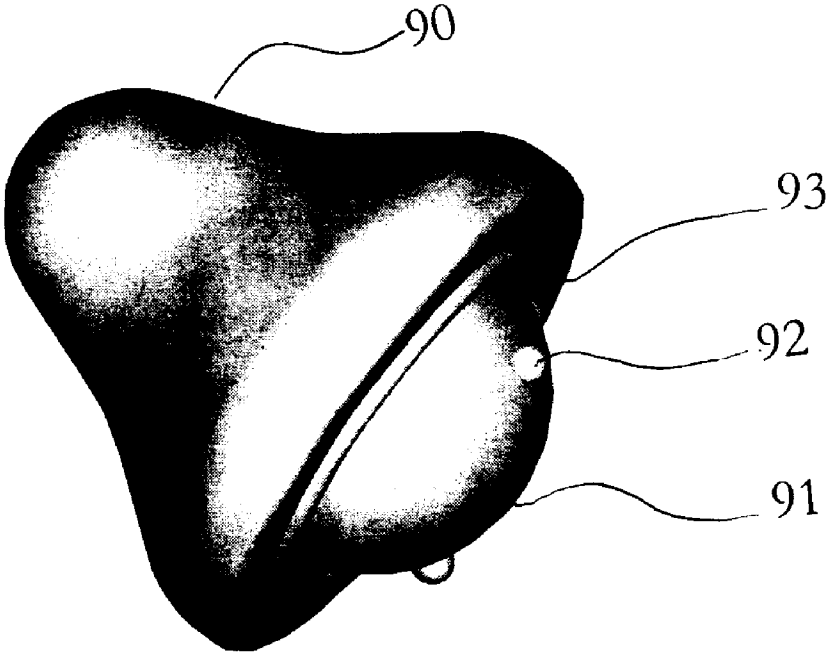

FIG. 9 is a representation of a single piece penetrator that features a conical end portion (90), a continuously curved interfacial surface (91) and projections (92) and (93) on the surfaces likely to contact the base segment or an additional intermediate segment. The segment may be composed of one or more grades of the cemented carbide, including a composition of diamond, cubic boron nitride, and tungsten carbide. The projections serve to provide a consistent opening for the migration of bonding material when the segment is attached to the tool body. The curved interfacial surface (91) is unmatched with the apposed surface in order to provide for the concentration of the bonding material near the central axis of the segment. The segment also features a contour for directing the flow of the disintegrated material away from the tool body.

What is claimed:

1. A pick type tool for disintegrating natural and manmade materials, comprising:

a wear resistant base segment suitable for rotational attachment to a driving mechanism;

one or more additional segments each having higher wear resistance than the base segment; and the base and additional segments being bonded together along an unmatched, continuously curved interfacial surface having interruptions selected from the group consisting of grooves, spiral grooves, and flutes.

2. The pick type tool of claim 1, wherein the base segment comprises a steel alloy.

3. The pick type tool of claim 1, wherein the one or more additional segments comprise a material selected from the group consisting of a cemented carbide, cubic boron nitride, and polycrystalline diamond.

4. The tool of claim 1, wherein the one or more additional segments comprises a coating of polycrystalline diamond at least a portion of which is produced by the HPHT method without using a metal catalyst.

5. The tool of claim 3, wherein the one or more additional segments comprise polycrystalline diamond having its residual metal catalyst removed.

6. The tool of claim 3, wherein the one or more additional segments comprise a binderless carbide.

7. The tool of claim 3, wherein the one or more additional segments comprise carbide produced by the rapid omnidirectional compaction method.

8. The tool of claim 1, wherein the one or more additional segments comprises natural diamond particles.

9. The tool of claim 1, wherein the one or more additional segments are attached to the base segment and to each other along the unmatched, interfacial curved surface using a braze material.

10. The tool of claim 9, wherein the braze material is non-uniformly distributed along the unmatched, interfacial curved surfaces of the segment or segments.

11. The tool of claim 9, wherein the braze material is concentrated in the region of highest variance along the unmatched, interfacial curved surface of the segment or segments.

12. The tool of claim 9, wherein the one or more additional segments are brazed together without substantially altering the grain size of the metal binder in the carbide.

* * * * *

UNITED STATES PATENT AND TRADEMARK OFFICE

CERTIFICATE OF CORRECTION

PATENT NO. : 6,733,087 B2
DATED : May 11, 2004
INVENTOR(S) : Hall, David R.

It is certified that error appears in the above-identified patent and that said Letters Patent is hereby corrected as shown below:

Drawings,
Delete Figures 1-9 and substitute with Figures 1-9, on the attached pages.

Signed and Sealed this

Sixth Day of September, 2005

JON W. DUDAS
*Director of the United States Patent and Trademark Office*